United States Patent [19]

DePinna

[11] 4,161,074

[45] Jul. 17, 1979

[54] THREE-DIMENSIONAL PRODUCT MARKER

[75] Inventor: George L. DePinna, Forest Hills, N.Y.

[73] Assignee: Goodren Products Corp., Englewood, N.J.

[21] Appl. No.: 780,166

[22] Filed: Mar. 22, 1977

[51] Int. Cl.[2] ..... G09F 1/00

[52] U.S. Cl. ..... 40/124.1; 40/538

[58] Field of Search ..... 40/16, 124.1, 126 A, 40/125, 21 B, 538, 584

[56] References Cited

U.S. PATENT DOCUMENTS

| | | | |
|---|---|---|---|
| 2,427,629 | 9/1947 | Smith et al. | 40/124.1 |
| 2,984,031 | 5/1961 | Giesecke | 40/16 |
| 3,432,953 | 3/1969 | Pinzke | 40/124.1 |
| 4,054,001 | 10/1977 | De Pinna | 40/126 A |

*Primary Examiner*—Louis G. Mancene
*Assistant Examiner*—Wenceslao J. Contreras
*Attorney, Agent, or Firm*—Brumbaugh, Graves, Donohue & Raymond

[57] ABSTRACT

A three-dimensional product marker of one-part construction for mounting in the channel of a stocking shelf includes a generally rectangular flexible flat sheet which has an information-bearing front surface and support panels which extend outwardly from the side edges of the flat sheet and have information-bearing rear surfaces. A vertical slit is formed in the flat sheet near one of the support panels and is sized to receive the other of the support panels and thereby permit the panels to be pulled across and away from each other behind the flat sheet to impart a cylindrical shape to the flat sheet and place on the same side the information-bearing surfaces of the flat sheet and the support panels.

6 Claims, 3 Drawing Figures

THREE-DIMENSIONAL PRODUCT MARKER

BACKGROUND OF THE INVENTION

This invention relates to advertising display devices for mounting in the channels of stocking shelves in retail stores and, more particularly, to three-dimensional product markers of one-part construction.

The Tanney U.S. Pat. No. 3,791,149, owned by the assignee of this application, discloses a three-dimensional display device including a flexible printed sheet divided into two sections by a fold line. One section is curled back and around to impart a cylindrical shape to the section. Bands of adhesive secure the sections together and maintain the cylindrical shape of the one section. The Chittum U.S. Pat. No. 2,401,615 discloses a display card to which is appended a tab that may be bent back and through a slit formed in the card to form an article retaining sleeve or pocket. The Pradt U.S. Pat. No. 2,115,449 discloses a display support having a tab with slits formed therein to provide a protruding portion which provides means for attaching the support to any suitable surface. The Sauer U.S. Pat. No. 2,255,535 describes a display card with a front cover sheet that is held partially over the back cover sheet thereof to display both covers.

SUMMARY OF THE INVENTION

In accordance with the present invention, a three-dimensional product marker for mounting in or on the channel of a stocking shelf comprises a flat flexible sheet having upper, lower and side edges and bearing printed information on its front surface. A pair of support panels, sized for retention in the channel of a stocking shelf, extend outwardly from the side edges of the flat sheet. The panels bear printed information on their rear surfaces.

A vertical slit is formed in the flat sheet adjacent one of the support panels. It is substantially perpendicular to the side panels and is sized to receive the other of the support panels. A three-dimensional display is formed by inserting the other of the support panels through the vertical slit and pulling the first and second support panels across and then away from each other. The display will then show on the same side the information-bearing surfaces of the sheet and the support panels.

Preferably, an adhesive strip extends between the upper and lower edges of the flat sheet adjacent the other support panel to secure the ends of the sheet in place upon formation of the display. Also, the other support panel includes notches formed therein which lock into the vertical slit formed in the flat sheet to control the extent to which the support panels may be pulled away from each other. Additional notches formed in the support panels facilitate insertion of the panels into the channel of a stocking shelf. Still further, an instruction tab is releasably attached to one of the support panels by a score line.

DESCRIPTION OF THE PREFERRED EMBODIMENT

Figure 1:
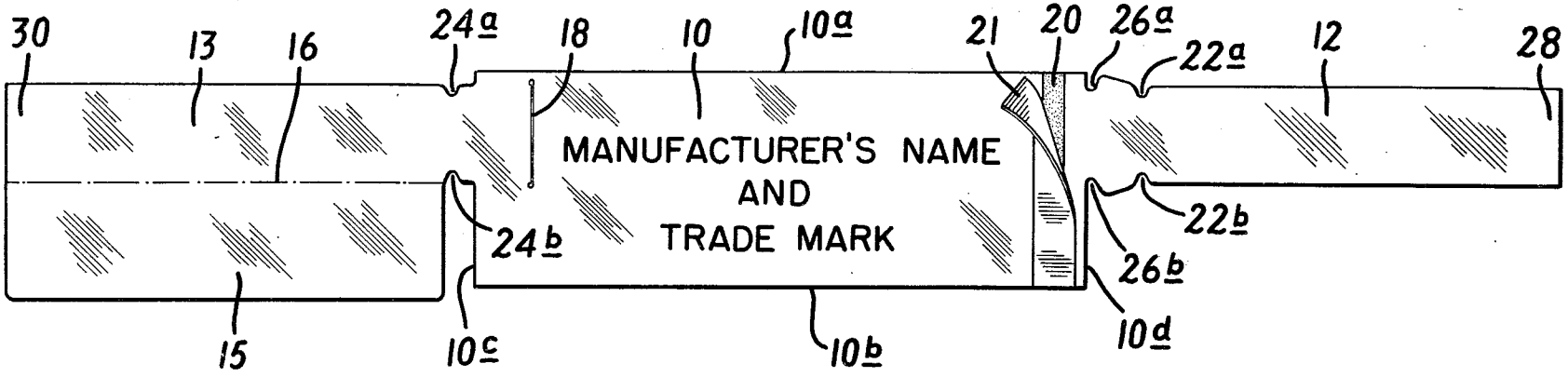
FIG. 1 is a front view of a three-dimensional product marker arranged according to the present invention.
Figure 2:
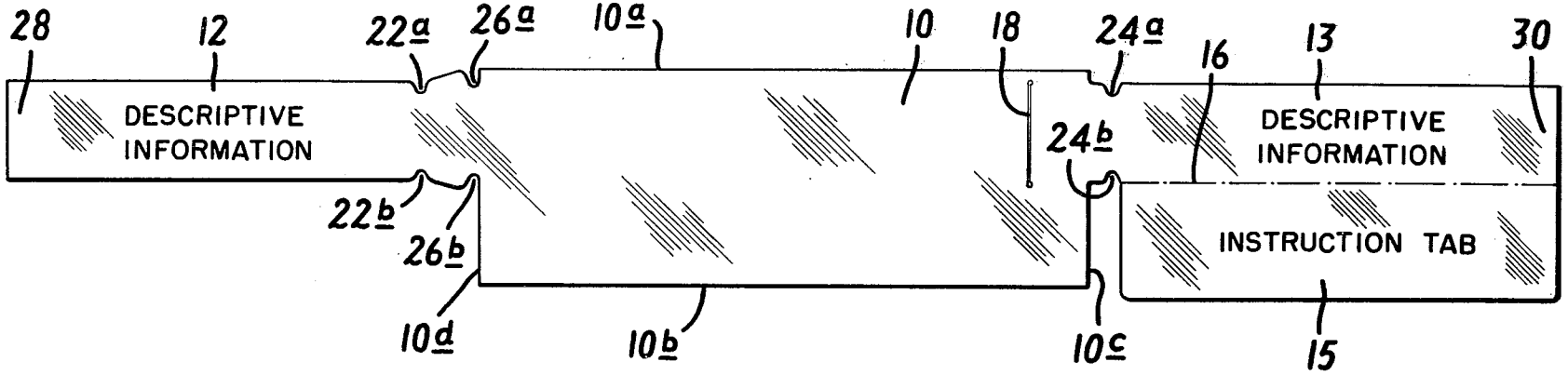
FIG. 2 is a rear view of the FIG. 1 product marker.
Figure 3:
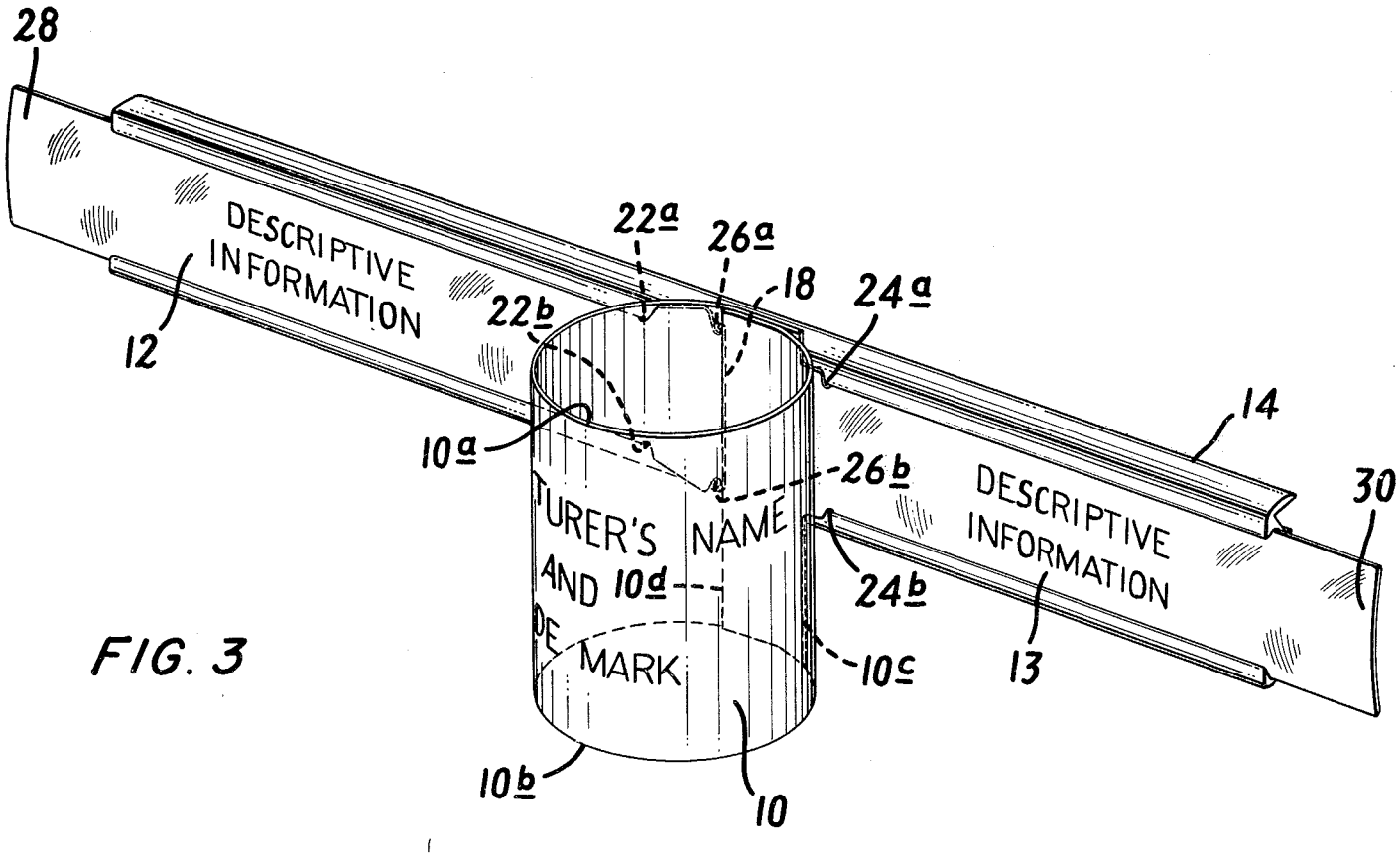
FIG. 3 is a perspective view of the FIG. 1 product marker installed in the channel of a stocking shelf.

In the illustrative embodiment of a three-dimensional product marker for mounting in or on the channel of a stocking shelf and arranged according to the present invention, as shown in FIGS. 1–3, there is provided a generally rectangular translucent sheet 10 having an upper edge **10*a*, a lower edge 10*b* and side edges 10*c* and 10*d*. Also provided are a pair of translucent support panels 12 and 13 which extend outwardly from the side edges 10*d* and 10*c*, respectively, of the sheet and are sized for insertion into the channel 14 of a stocking shelf (FIG. 3). An instruction tab 15 is releasably attached to the support panel 13 by means of a score line 16. Preferably, the sheet 10, the panels 12 and 13 and the tab 15 are of one-part construction formed from a single sheet of flexible thermoplastic material which has both surfaces capable of receiving and retaining printed information, e.g., advertising information. As shown, a manufacturer's name and its trademark are printed on the front surface of the sheet 10, while description information is printed on the rear surfaces of the support panels 12 and 13 and instructions are printed on the rear surface of the tab 15**.

As shown in FIG. 1, the sheet 10 has a vertical slit 18 formed therein adjacent its side edge **10*c* and the side panel 13. The slit 18 extends perpendicularly of the support panels and is sized to receive and pass therethrough the support panel 12. A pressure adhesive strip 20, covered by release paper 21 extends along the side edge 10*d* between the upper and lower edges 10*a* and 10*b***, respectively, on the front surface of the sheet.

The support panels 12 and 13 have notches **22*a*, 22*b* and 24*a*, 24*b*, respectively, which facilitate insertion of the panels into the channel 14. Panel 12 includes a second set of notches 26*a*, 26*b* adjacent the side edge 10*d* and the adhesive strip 20 of the sheet 10. Upon installation, the notches 26*a*, 26*b* lock into the vertical slit 18 and control the extent to which the support panels 12 and 13 may be pulled away from each other. Optionally, the support panels 12 and 13** may include on their front surfaces and at the outside ends of the panels pressure adhesive strips (not shown). Such strips would be provided in the event the device of this invention were to be mounted on a channel having a flat surface.

In use, instruction tab 15 is detached from the support panel 13. With the front surface of the product marker facing the user, as in FIG. 1, the panel 12 is rolled backwardly behind the sheet 10 and then inserted through the vertical slit 18. The user pulls the panel 13 to the right and the panel 12 firmly to the left as viewed in FIG. 1 until the second set of notches **26*a*, 26*b* lock into the vertical slit 18. The product marker will now have a three-dimensional shape with the sheet 10 having a cylindrical configuration protruding from the support panels 12 and 13. Also, the product marker will include on the same side the advertising-bearing surfaces of the sheet 10 and the panels 12 and 13. The fish paper strip 21 is then removed from the adhesive 20 and, making certain that the formed cylinder is aligned correctly, the opposite surfaces of the side edges 10*c*, 10*d* of the sheet 10 are pressed together to sandwich the adhesive between them and secure the cylindrical shape of the sheet 10**.

The assembled three-dimensional product marker is now ready for installation. This is accomplished by pressing the side panels 12 and 13 into the channel 14 of the stocking shelf until the panels lock into place. The side panels 12 and 13 fit into the channel 14 from their respective notches *22a, 22b* and *24a, 24b* to the ends thereof.

Although the invention has been described herein with reference to a specific embodiment, many modifications and variations therein will readily be apparent to those skilled in the art. Accordingly, all such variations and modifications are included within the intended scope of the invention as defined by the following claims.

I claim:

1. A three-dimensional product marker comprising a flat flexible sheet having an information-bearing front surface and having upper, lower and side edges, and first and second support panels extending outwardly from side edges of the flat sheet, said panels having front and rear surfaces, and said flat sheet having a vertical slit formed in the sheet adjacent the first support panel, said vertical slit spaced from said upper and lower edges and sized to receive the second support panel and thereby permit the first and second support panels to be pulled across and away from each other behind the flat sheet to impart a three-dimensional shape to the flat sheet and place on the same side the information-bearing surface of the flat sheet and the rear surfaces of the support panels.

2. A three-dimensional product marker comprising a flat flexible sheet having an information-bearing front surface and having upper, lower and side edges, and first and second support panels extending outwardly from the side edges of the flat sheet, said panels having front and rear surfaces, and said flat sheet having a vertical slit formed in the sheet adjacent the first support panel, said vertical slit spaced from said upper and lower edges and sized to receive the second support panel and thereby permit the first and second support panels to be pulled across and away from each other behind the flat sheet to impart a three-dimensional shape to the flat sheet and place on the same side the information-bearing surface of the flat sheet and the rear surfaces of the support panels, wherein the rear surface of at least one of the support panels has information printed thereon and further comprising an adhesive strip on the front surface of the flat sheet which extends between the upper and lower edges of the flat sheet adjacent the second support panel for joining the opposite surfaces of the side edges of the sheet and thereby secure the three-dimensional configuration of the sheet.

3. A three-dimensional product marker comprising a flat flexible sheet having an information-bearing front surface and having upper, lower and side edges, and first and second support panels extending outwardly from the side edges of the flat sheet, said panels having front and rear surfaces, and said flat sheet having a vertical slit formed in the sheet adjacent the first support panel, said vertical slit spaced from said upper and lower edges and sized to receive the second support panel and thereby permit the first and second support panels to be pulled across and away from each other behind the flat sheet to impart a three-dimensional shape to the flat sheet and place on the same side the information-bearing surface of the flat sheet and the rear surfaces of the support panels, wherein the second support panel has notches formed therein for locking into the vertical slit formed in the flat sheet to control the extent to which the first and second panels may be pulled away from each other.

4. A three-dimensional product marker according to claim 3 wherein the first and second support panels have further notches formed therein to facilitate their insertion into the channel of a stocking shelf.

5. A three-dimensional product marker according to claim 4 further comprising an instruction tab and having an information-bearing surface releasably attached to one of the support panels by a score line.

6. A three-dimensional product marker according to claim 5 wherein the flat sheet has a generally rectangular configuration that is flexed into a cylindrical configuration with the pulling of the first and second support panels away from each other.

* * * * *